US008944553B2

(12) United States Patent
Walker et al.

(10) Patent No.: US 8,944,553 B2
(45) Date of Patent: Feb. 3, 2015

(54) FLUSH LINE GENERATION IN PRINTING SYSTEMS THAT UTILIZE CONTROL MARKS

(71) Applicants: Casey E. Walker, Boulder, CO (US); Scott Johnson, Erie, CO (US); Sean K. Fitzsimons, Thornton, CO (US); Stuart J. Boland, Denver, CO (US); William Edward Manchester, Erie, CO (US)

(72) Inventors: Casey E. Walker, Boulder, CO (US); Scott Johnson, Erie, CO (US); Sean K. Fitzsimons, Thornton, CO (US); Stuart J. Boland, Denver, CO (US); William Edward Manchester, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 13/774,602

(22) Filed: Feb. 22, 2013

(65) Prior Publication Data

US 2014/0240385 A1 Aug. 28, 2014

(51) Int. Cl.
*B41J 29/38* (2006.01)
*B41J 2/165* (2006.01)

(52) U.S. Cl.
CPC ..... *B41J 2/165* (2013.01)
USPC ..... 347/14; 347/9

(58) Field of Classification Search
CPC .... B41J 2/0458; B41J 2/04563; B41J 29/393; B41J 2/04591; B41J 2/04581
USPC ..... 347/9, 14, 16, 19, 23
See application file for complete search history.

(56) References Cited

U.S. PATENT DOCUMENTS

| | | | | |
|---|---|---|---|---|
| 7,198,350 | B2 | 4/2007 | Nakashima | |
| 7,325,450 | B2 | 2/2008 | Usui et al. | |
| 7,431,420 | B2 | 10/2008 | Inoue | |
| 7,857,420 | B2 | 12/2010 | Reid | |
| 8,262,196 | B2 | 9/2012 | Mitchell et al. | |
| 2006/0214979 | A1 * | 9/2006 | Inoue | 347/22 |
| 2010/0053241 | A1 | 3/2010 | Chandu et al. | |
| 2010/0119273 | A1 * | 5/2010 | Komai et al. | 399/395 |
| 2010/0245421 | A1 * | 9/2010 | Sakano | 347/9 |
| 2011/0211899 | A1 * | 9/2011 | Teshigawara et al. | 400/621 |

* cited by examiner

*Primary Examiner* — Manish S Shah
*Assistant Examiner* — Yaovi Ameh
(74) *Attorney, Agent, or Firm* — Duft Bornsen & Fettig LLP

(57) ABSTRACT

Systems and methods are provided for generating flush lines that do not interfere with control marks for post-processing equipment. The system includes a print controller able to receive a print job and to insert printable control marks into the print job to direct the actions of post-processing equipment. The system also includes an ink flushing controller that can detect horizontal locations of the control marks along the width of the print job. Responsive to detecting the locations of the control marks, the ink flushing controller can generate flush lines for the print job that have altered optical densities at the horizontal locations.

20 Claims, 6 Drawing Sheets

FLUSH LINE GENERATION IN PRINTING SYSTEMS THAT UTILIZE CONTROL MARKS

FIELD OF THE INVENTION

The invention relates to the field of printing systems, and in particular, to generating flush lines for printing systems.

BACKGROUND

Businesses or other entities having a need for volume printing typically purchase a production printer. A production printer is a high-speed printer used for volume printing (e.g., one hundred pages per minute or more). Production printers are typically continuous-form printers that print on webs of print media which are stored on large rolls.

A production printer typically includes a localized print controller that controls the overall operation of the printing system, and a marking engine (sometimes referred to as an "imaging engine" or as a "print engine"). The marking engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. A printhead array is formed from multiple printheads that are spaced in series across the width of the print media.

When in operation, the web of print media is quickly passed underneath the printhead arrays while the nozzles of the printheads discharge ink at intervals to form pixels on the web. In order to ensure that ink does not dry onto the printheads during printing (which would adversely affect print quality), flush lines are printed at page boundaries on the web. These flush lines are used to flush ink from each of the nozzles (i.e., across the entire width of the web) on a regular basis to ensure that the ink does not become overly viscous.

Additionally, many printing systems utilize one or more control marks to guide the actions of post-processing equipment at the print shop. For example, a printing system may add control marks onto a web to indicate where to cut the web to form pages, how to stack groups of pages, and how to perform other post-printing activities.

Unfortunately, the sensors that trigger actions at post-processing equipment may use simple heuristics, such as optical density, to detect control marks on the page. This means that flush lines can be mistakenly interpreted as control marks by post-processing equipment, which can result in the print job being cut, stacked, hole-punched, etc. at the wrong location.

SUMMARY

Embodiments described herein provide systems that detect the horizontal location of control marks that have been inserted into a print job by a print controller. The systems reduce the optical density/reflectance of flush lines that are in substantially the same horizontal location along the width of the print job as the control marks. This keeps sensors for post-processing equipment from mistakenly identifying portions of the flush line as control marks.

One embodiment is a system that generates flush lines that do not interfere with control marks for post-processing equipment. The system includes a print controller able to receive a print job and to insert printable control marks into the print job to direct the actions of post-processing equipment. The system also includes an ink flushing controller that can detect horizontal locations of the control marks along the width of the print job. Responsive to detecting the locations of the control marks, the ink flushing controller can generate flush lines for the print job that have altered optical densities at the horizontal locations.

Another embodiment is a method. The method includes receiving a print job, and inserting printable control marks into the print job to direct the actions of post-processing equipment. The method also includes detecting horizontal locations of the control marks along the width of the print job. Responsive to detecting the locations of the control marks, the method also includes generating flush lines for the print job that have altered optical densities at the horizontal locations.

Another embodiment is a non-transitory computer readable medium embodying programmed instructions which, when executed by a processor, are operable for performing a method. The method includes receiving a print job, and inserting printable control marks into the print job to direct the actions of post-processing equipment. The method also includes detecting horizontal locations of the control marks along the width of the print job. Responsive to detecting the locations of the control marks, the method also includes generating flush lines for the print job that have altered optical densities at the horizontal locations.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
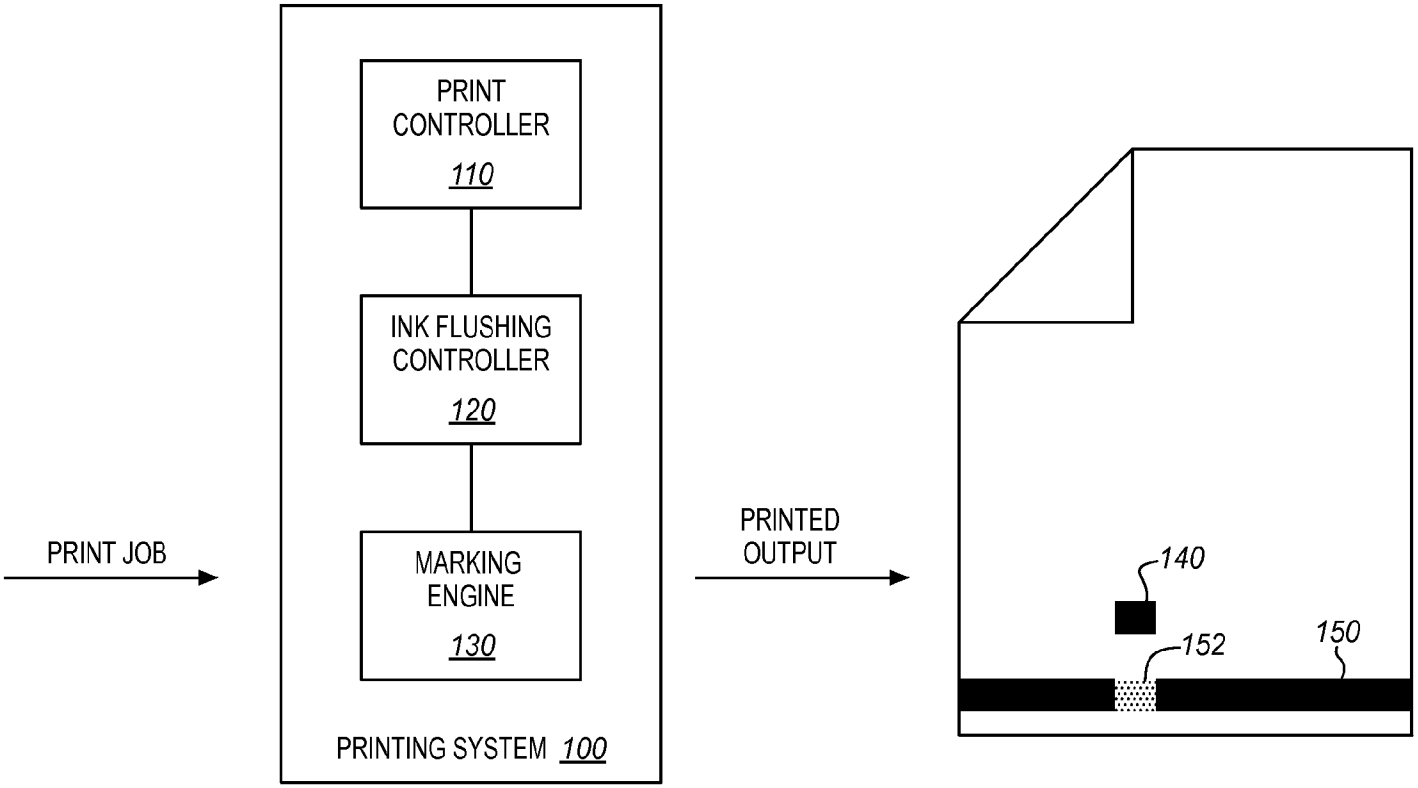
FIG. 1 is a block diagram of a printing system of a print shop in an exemplary embodiment.

FIG. 1 is a block diagram of a printing system 100 of a print shop in an exemplary embodiment. Printing system 100 receives print jobs from a customer (e.g., via a client, print server, etc.) that include print data for printing. Each print job is processed by printing system 100 to generate a printed output, and this printed output is manipulated by post-processing equipment to generate a final, deliverable product.

For example, the post-processing equipment may include cutters, stackers, hole-punchers, binders, perforators, and other post-printing devices.

Printing system 100 includes print controller 110, ink flushing controller 120, and marking engine 130. Print controller 110 may perform operations such as translating Page Description Language (PDL) print jobs into a rasterized format, processing job tickets for the print job, and other functions. Print controller 110 also generates control marks that are inserted/overlaid onto print jobs from customers. The control marks, when printed onto the job, provide instructions that direct the operations of post-processing equipment in the print shop. For example, a control mark may direct a cutter to cut at a given vertical location, may instruct a stacker to start a new stack of pages at a boundary between print jobs, may instruct a hole-puncher where to punch holes, etc. Control mark 140 is an example of such a control mark. Control marks are often located at the margins of a given page (e.g., the top, bottom, or sides), or in other locations that will not draw the attention of a customer away from the content of the print job itself (e.g., billing statements, chapters of a book, etc.). While control mark 140 is illustrated as a black square, any shape, design, or color may be used to implement control marks. In one embodiment, control marks of different shapes provide different instructions to post-processing equipment.

The control marks inserted by print controller 110 are located at specific horizontal locations along the width of the print job/page/web. When the print job is printed out onto the web, the web is driven toward downstream post-processing equipment. Sensors for each piece of post-processing equipment have been placed at specific horizontal locations along the width of the web, and have been calibrated to search for control marks at these specific horizontal locations. The sensors used by each piece of post-processing equipment may vary, but many sensors utilized will trigger their associated post-processing equipment whenever a sufficiently dark mark (i.e., a mark with a large enough optical density/reflectance) is detected. As used herein, the term "optical density" refers to optical density and/or optical reflectance, and refers to these measurements taken in any suitable spectrum including (but not limited to) the visible and infrared spectrums.

Because printing system 100 is an ink-based printing system, printing system 100 utilizes ink flushing controller 120 to generate flush lines at regular intervals throughout the print job. Like the control marks, the flush lines do not exist in the print job at the time the print job is received. The flush lines prevent ink from drying out (or becoming more viscous) at the nozzles of marking engine 130 and thereby adversely impacting print quality. In most systems, flush lines are printed on every page of a print job, along the entire width of the print job (i.e., along the width of the web/page).

Because flush lines are often uniform across the entire width of the page, and because flush lines are often very dark, sensors for post-processing equipment can misinterpret flush lines as control marks. This means that the print job may be cut, stacked, hole-punched, etc. at the wrong location. Such a result may necessitate re-printing the print job, at great cost to the print shop operator.

Ink flushing controller 120 has been enhanced to vary the optical density of the flush lines that it generates, based on the existence of detected control marks for the print job. For example, ink flushing controller 120 can reduce the intensity of a generated flush line at a given horizontal location, if a control mark is known to occupy the same horizontal position.

Ink flushing controller 120 may be implemented, for example, as custom circuitry, as a special or general purpose processor executing programmed instructions stored in an associated program memory, or some combination thereof. While ink flushing controller 120 is illustrated as an independent element in FIG. 1, in some embodiments ink flushing controller may be integrated into print controller 110, or marking engine 130.

Once flush lines and control marks have been added to the print job, the print job is provided to marking engine 130, which marks a web of print media to generate a printed output. In FIG. 1, the printed output includes flush line 150 and control mark 140. Here, flush line 150 has been generated so that it is less optically dense at the location along the width of the page at which control mark 140 is located.

Illustrative details of the operation of printing system 100 will be discussed with regard to FIG. 2. Assume, for this embodiment, that printing system 100 has initialized and that print controller 110 has been programmed with information describing available pieces of post-processing equipment, as well as the location at which to place control marks for each piece of post-processing equipment.

Figure 2:
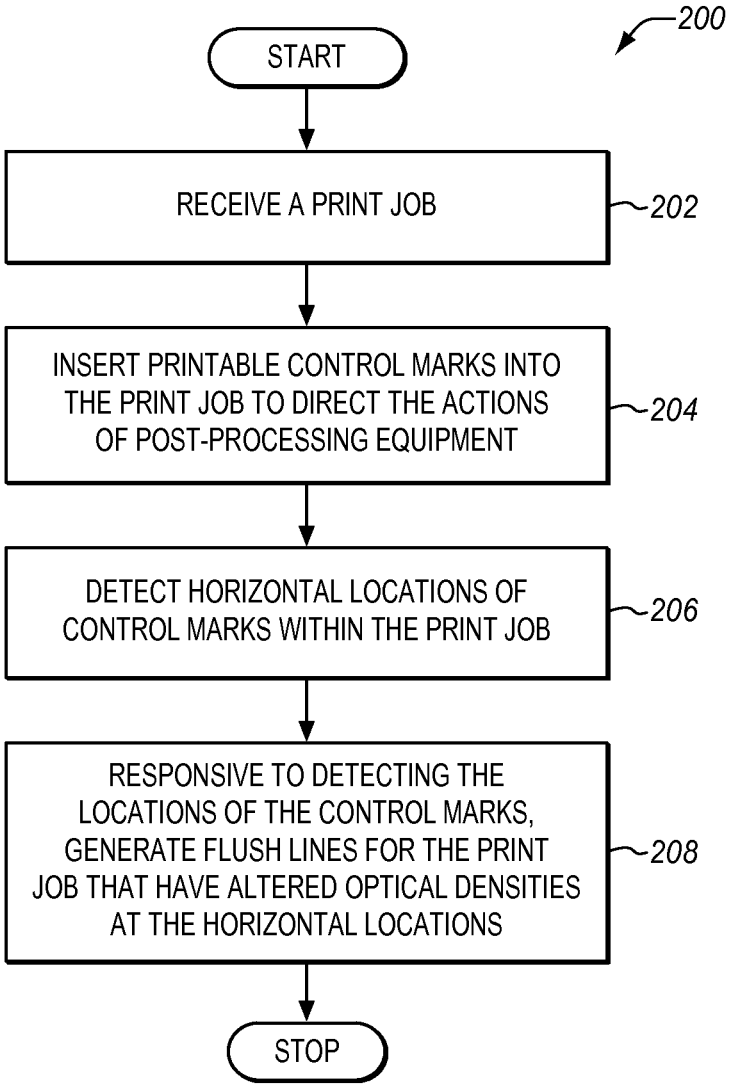
FIG. 2 is a flowchart illustrating a method for operating a printing system to generate flush lines in an exemplary embodiment.

FIG. 2 is a flowchart illustrating a method 200 for operating a printing system to generate flush lines in an exemplary embodiment. The steps of method 200 are described with reference to printing system 100 of FIG. 1, but those skilled in the art will appreciate that method 200 may be performed in other systems. The steps of the flowcharts described herein are not all inclusive and may include other steps not shown. The steps described herein may also be performed in an alternative order.

In step 202, print controller 110 receives a print job for processing. The print job comprises one or more logical pages of print data for printing by printing system 100. Print controller 110 may receive the print job via a network interface, a serial communication interface, etc.

In step 204, print controller 110 inserts printable control marks into the print job to direct the actions of post-processing equipment. In one embodiment, print controller 110 performs this step by reviewing a job ticket for the print job to determine how the print job should be manipulated by post-processing equipment. Print controller 110 then correlates the parameters from the job ticket with known pieces of post-processing equipment in the print shop. Based on known horizontal locations of sensors for the post-processing equipment along the width of the page, print controller 110 generates control marks to direct the post-processing equipment to perform the operations requested by the job ticket. Print controller 110 may further rasterize the print job from a Page Description Language (PDL) format into a bitmap version.

In step 206, ink flushing controller 120 detects the horizontal locations of control marks that have been inserted into the print job. In embodiments where the print job is in a PDL format when analyzed by ink flushing controller 120, the control marks may be indicated with specific tags, data structures, or other information that indicates the marks are used to direct post-processing equipment. In embodiments where ink flushing controller 120 analyzes a rasterized version of the print job for control marks, the control marks may be identified based upon their shapes, sizes, colors, or other characteristics.

Having detected the locations of the various control marks along the width of the print job, ink flushing controller 120 generates flush lines for the print job. The flush lines have varying optical density (e.g., darkness) along the width of the print job, and the varying optical density is based on the locations of the detected control marks along the width of the print job. Specifically, the optical densities of the flush lines have been altered where they occupy the same horizontal position as a control mark. For example, a flush line may be made lighter when it is in the same location along the width of the page as a control mark. This reduces the chances of a sensor for post-processing equipment falsely identifying the flush line as another control mark.

In a further embodiment, ink flushing controller 120 determines the optical density of each control mark, and may specifically alter the flush line at the horizontal location of detected marks to be below the determined optical density. For example, if the control mark is 50% grey, the portion of the flush line at the same location may be reduced to 40% grey, or some other value. In another embodiment, ink flushing controller 120 determines the sensitivity of down-stream sensors for detected control marks. For example, ink flushing controller 120 may determine a threshold of optical density that will cause the sensor to trigger. Ink flushing controller 120 may then adjust the optical density of the flush line from a default value to less than the triggering threshold to ensure that the sensor does not trigger by mistake when the flush line passes by. Altering the optical density may include, for example, removing all or a portion of the flush line at the same horizontal position as the control mark.

FIGS. 3-6 are block diagrams illustrating exemplary flush lines on a printed page in various exemplary embodiments.

Figure 3:
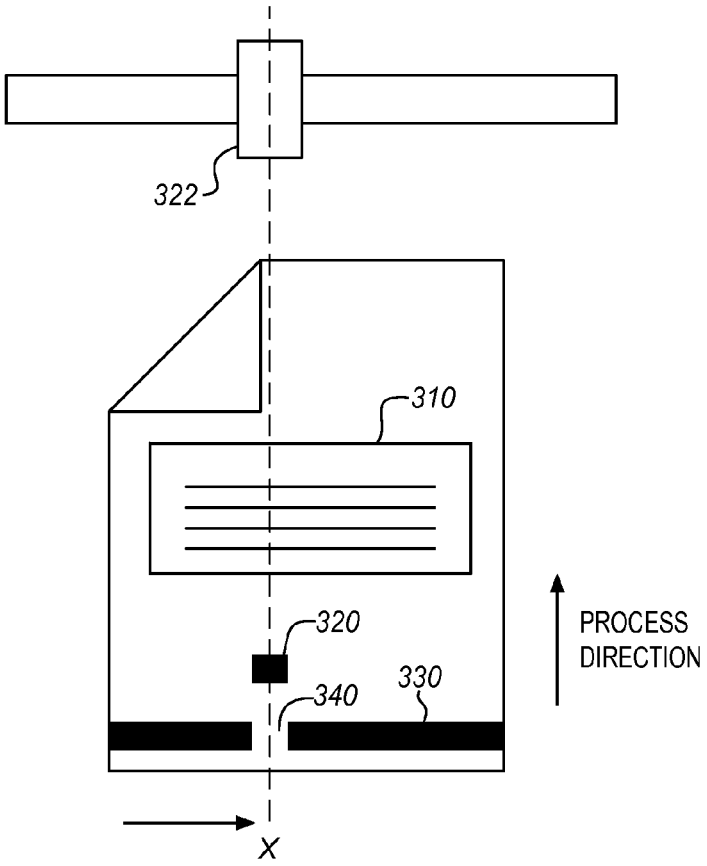
FIGS. 3-6 are block diagrams illustrating exemplary flush lines on a printed page in various exemplary embodiments.

According to FIG. 3, a printed page (currently integrated into a web of print media) includes printed content 310, which corresponds to print data requested for printing by a customer (e.g., billing statements, chapters of a book, etc.). The printed page further includes control mark 320, and flush line 330. Ink flushing generator 120 has detected a horizontal location (X) of control mark 320 along a width of the page. Control mark 320 is placed at horizontal location X because a downstream sensor 322 for post-processing equipment is oriented to detect marks on the web at horizontal location X. Thus, when the page (currently integrated into a web of print media) passes underneath sensor 322, sensor 322 will detect control mark 320 and trigger the post-processing equipment. In order to prevent false positives from sensor 322, ink flushing generator 120 removes a portion 340 of flush line 330 where flush line 330 would overlap the horizontal location of control mark 320. In this manner, sensor 322 will not misinterpret flush line 330 as another control mark.

Figure 4:
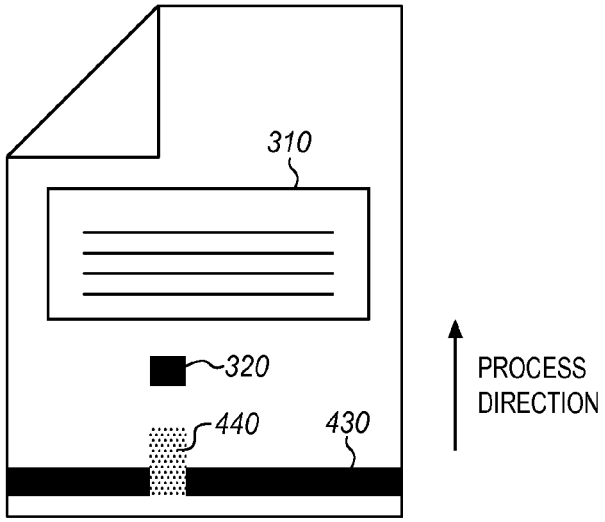

FIG. 4 illustrates a similar scenario to that described for FIG. 3. However, in FIG. 4, the portion of flush line 430 at the horizontal location of control mark 320 is reduced in intensity (not removed entirely). Furthermore, the overall height of a portion 440 of flush line 430 is increased, so that the same amount of ink is flushed, but over a longer span. Thus, flush line 430 flushes the desired amount of ink and also does not interfere with control mark 320.

Figure 5:
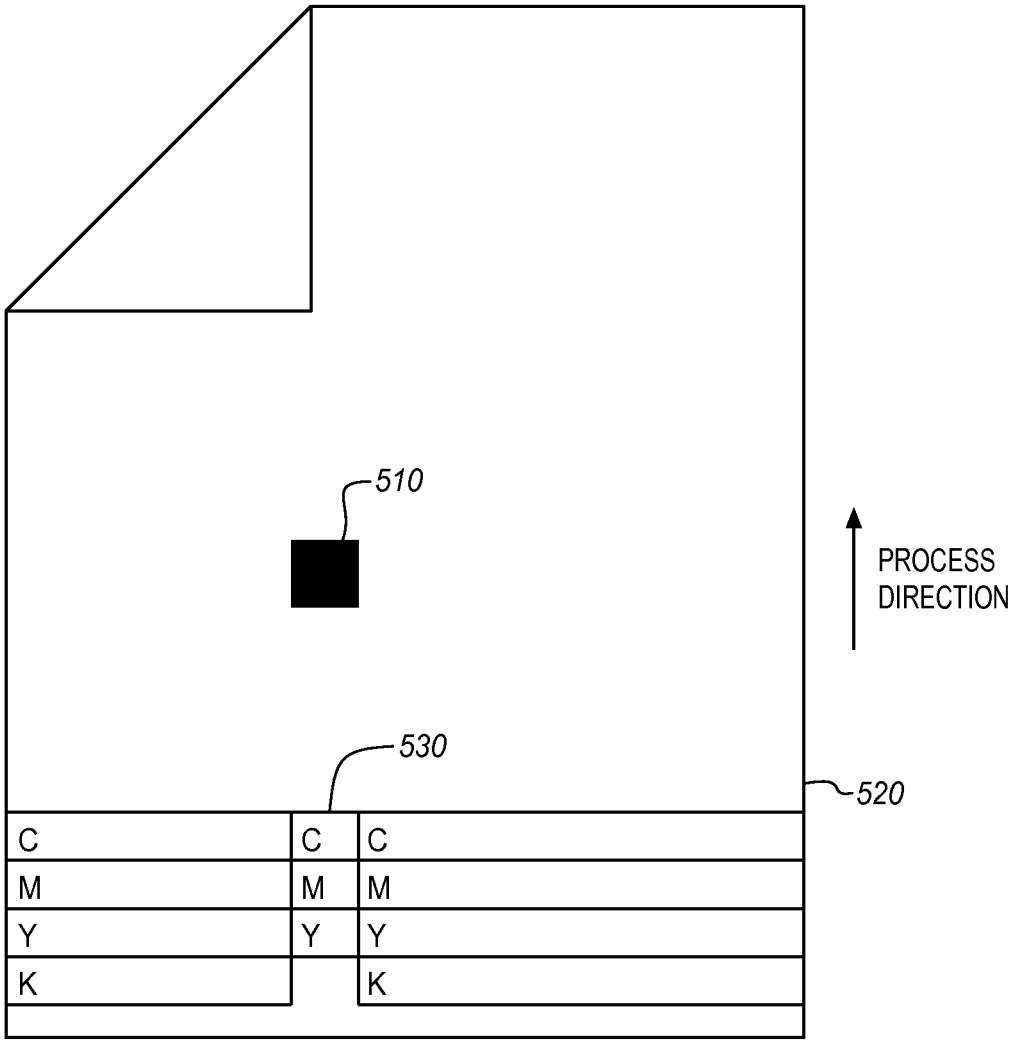

FIG. 5 illustrates a further scenario, wherein a multicolor CMYK (Cyan, Magenta, Yellow, Black) flush line 520 is altered based on a detected control mark. According to FIG. 5, control mark 510 utilizes black ink. Therefore, black ink will already be flushed from the print nozzles at the horizontal location for control mark 510, regardless of whether a flush line is used in that horizontal location Ink flushing controller 120 detects this, and removes black ink from portion 530 of flush line 520. This reduces the optical density of the flush line, while still allowing most of the nozzles of the printhead to completely flush. While FIG. 5 discusses black ink specifically, in further embodiments ink flushing controller 120 may be operable to detect the color of control mark 510, and to selectively remove inks from portion 530 of flush line 520 based on the color of control mark 510.

In a further embodiment, ink flushing controller 120 may determine a frequency at which a control mark repeats, and may adjust the intensity of the flush line at the same horizontal location as the control mark, based on the frequency of the control mark. For example, if a control mark repeats once every two pages and utilizes substantially the same amount of ink as a single flush line, the flush line may be printed at half of its default intensity where it is in the same horizontal location as the control mark. In this way, the same amount of ink is flushed in that horizontal location as in other locations.

In a further embodiment, ink flushing controller 120 is operable to reduce the intensity of the flush line where the flush line occupies the same horizontal location as a control mark. Ink flushing controller 120 further applies the ink that would have been applied to the flush line to the exact same physical position as the control mark (i.e., directly on top of the control mark). In this scenario, particularly when the control mark is black, the ink that is flushed into the control mark is substantially undetectable.

Examples

In the following examples, additional processes, systems, and methods are described in the context of a continuous-forms ink printing system that utilizes post-processing equipment.

Figure 6:
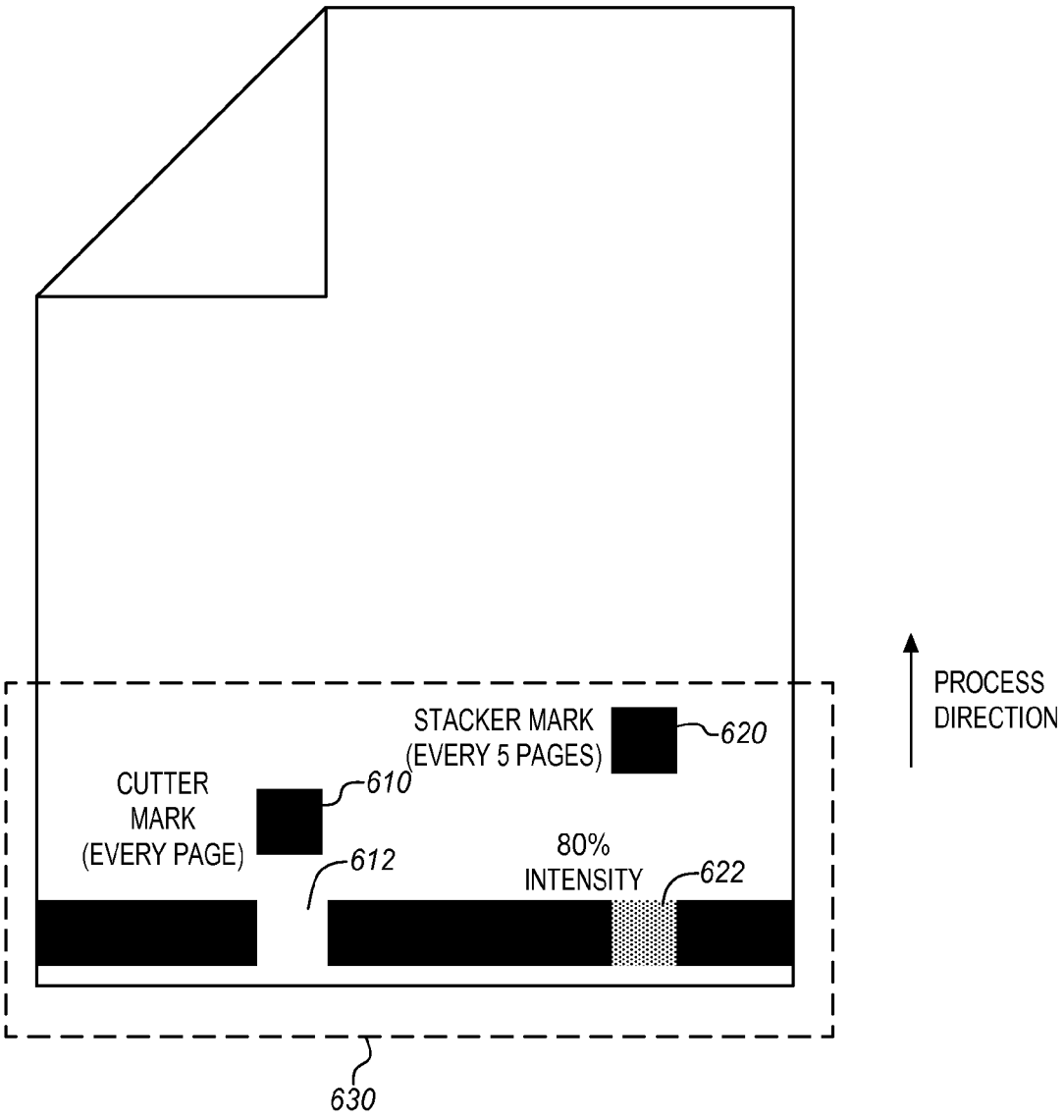

FIG. 6 illustrates a portion of a continuous-forms print media that is being driven toward post-processing equipment. In FIG. 6, all control marks are placed in a specific region 630 at the bottom of the page, and each type of control mark has a different horizontal position on the page. In this example, a cutter mark 610 has been added to each page, and cutter mark 610 indicates the location for a post-processing cutter to separate one page from another. Here, the pages are to be cut into letter-sized sheets of paper. Region 612 of the flush line for the page has been altered to substantially remove the flush line where it overlaps with the horizontal position of cutter mark 610.

The page also includes stacker mark 620, which occurs only once every five pages, and indicates a job boundary where a new stack should be formed by a post-processing stacker. To ensure that flushing still adequately occurs for this horizontal portion of the job, an ink flushing controller generates region 622 of the flush line at 80% of the default flush line intensity. Thus, every five pages, the ink from the flush lines from those pages, combined with the ink from the stacker mark, is roughly the same amount of ink that is flushed from other horizontal location on the job.

Figure 7:
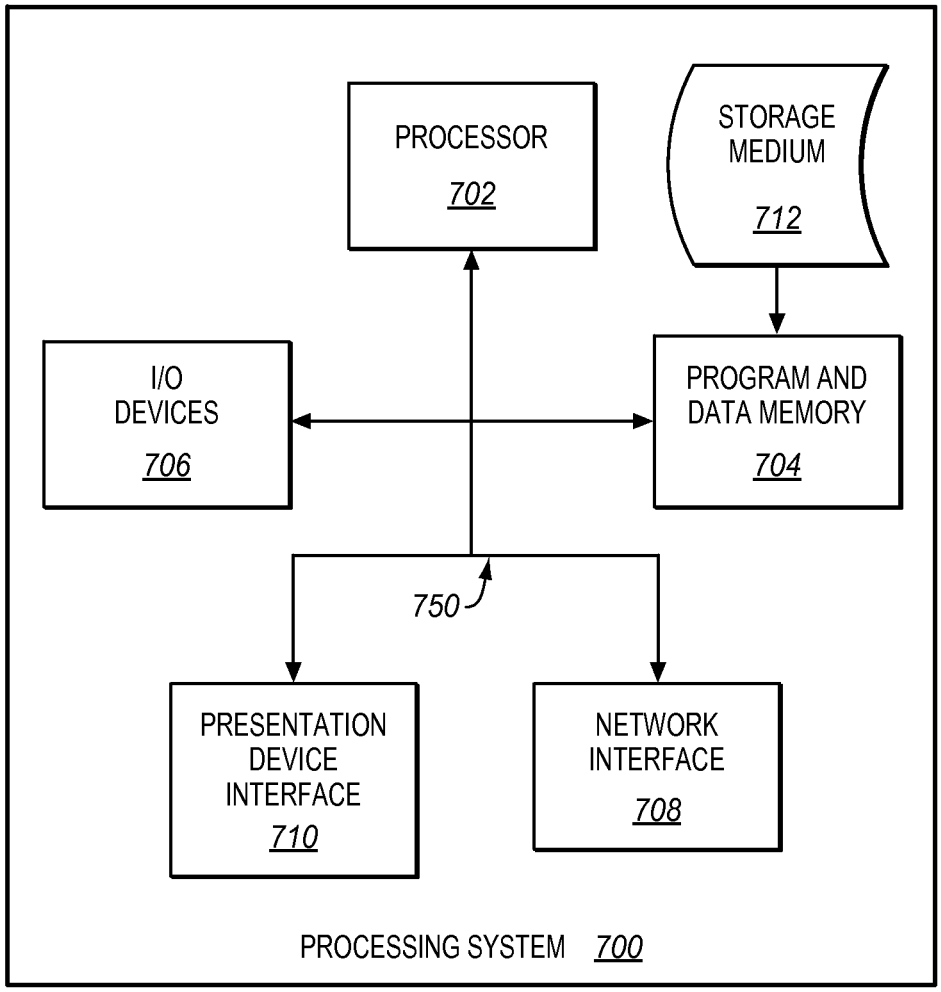
FIG. 7 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of printing system 100 to perform the various operations disclosed herein. FIG. 7 illustrates a processing system 700 operable to execute a computer readable medium embodying programmed instructions to perform desired functions in an exemplary embodiment. Processing system 700 is operable to perform the above operations by executing programmed instructions tangibly embodied on computer readable storage medium 712. In this regard, embodiments of the invention can take the form of a computer program accessible via computer-readable medium 712 providing program code for use by a computer or any other instruction execution system. For the purposes of this description, computer readable storage medium 712 can be anything that can contain or store the program for use by the computer.

Computer readable storage medium 712 can be an electronic, magnetic, optical, electromagnetic, infrared, or semiconductor device. Examples of computer readable storage medium 712 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 700, being suitable for storing and/or executing the program code, includes at least one processor 702 coupled to program and data memory 704 through a system bus 750. Program and data memory 704 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 706 (including but not limited to keyboards, displays, pointing devices, etc.) can be coupled either directly or through intervening I/O controllers. Network adapter interfaces 708 may also be integrated with the system to enable processing system 700 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 710 may be integrated with the system to interface to one or more presentation devices, such as printing systems and displays for presentation of presentation data generated by processor 702.

Although specific embodiments were described herein, the scope of the invention is not limited to those specific embodiments. The scope of the invention is defined by the following claims and any equivalents thereof.

We claim:

1. A system comprising:

a print controller operable to receive a print job and to insert printable control marks into the print job that direct the actions of post-processing equipment handling the print job; and an ink flushing controller operable to detect horizontal locations of the control marks along the width of the print job, and responsive to detecting the locations of the control marks, to generate flush lines for the print job that have altered optical densities at the horizontal locations, thereby preventing visual conflicts between the flush lines and the control marks that would cause the flush lines to be interpreted as control marks.

2. The system of claim 1 wherein:

the ink flushing controller is further operable to generate a flush line having a default optical density, to identify an optical density of a control mark at a horizontal location along the width of the print job, and to modify the flush line to reduce the optical density of the flush line at the location below the optical density of the control mark.

3. The system of claim 1 wherein:

the ink flushing controller is further operable to generate a flush line having a default optical density, to identify a control mark at a horizontal location along the width of the print job, and to modify the flush line to remove the flush line from the location.

4. The system of claim 1 wherein:

the ink flushing controller is further operable to generate a flush line having a default optical density, to identify a control mark at a horizontal location along the width of the print job, to determine a triggering threshold of a down-stream sensor for the control mark, and to modify the flush line to reduce the optical density of the flush line at the location below the triggering threshold.

5. The system of claim 1 wherein:

the print controller is further operable to generate the control marks at pre-defined horizontal locations along the width of the print job based upon expected horizontal locations of sensors for the post-printing equipment.

6. The system of claim 1 wherein:

the ink flushing controller is further operable, for each page, to identify control marks within the page, and to generate a flush line for the page that has varying optical density along the width of the page based on the detected control marks for the page.

7. The system of claim 1 wherein:

the ink flushing controller is further operable to reduce the optical density of a flush line at the horizontal location of a detected control mark, and to increase the amount of ink applied to the detected control mark to compensate for the reduced optical density of the flush line.

8. The system of claim 1 wherein:

the ink flushing controller is further operable to determine a frequency at which a control mark at a horizontal location along the width of the print job repeats across multiple pages, and to reduce the optical density of a flush line at the horizontal location based on the frequency.

9. A method comprising:

receiving a print job;

inserting printable control marks into the print job that direct the actions of post-processing equipment handling the print job;

detecting horizontal locations of the control marks along the width of the print job; and responsive to detecting the locations of the control marks, generating flush lines for the print job that have altered optical densities at the horizontal locations, thereby preventing visual conflicts between the flush lines and the control marks that would cause the flush lines to be interpreted as control marks.

10. The method of claim 9 further comprising:

generating a flush line having a default optical density;

identifying an optical density of a control mark at a horizontal location along the width of the print job; and modifying the flush line to reduce the optical density of the flush line at the horizontal location below the optical density of the control mark.

11. The method of claim 9 further comprising:

generating a flush line having a default optical density;

identifying a control mark at a horizontal location along the width of the print job; and modifying the flush line to remove the flush line from the horizontal location.

12. The method of claim 9 further comprising:

generating a flush line having a default optical density;

identifying a control mark at a horizontal location along the width of the print job;

determining a triggering threshold of a down-stream sensor for the control mark; and modifying the flush line to reduce the optical density of the flush line at the location below the triggering threshold.

13. A non-transitory computer readable medium embodying programmed instructions which, when executed by a processor, are operable for performing a method comprising:

receiving a print job;

inserting printable control marks into the print job that direct the actions of post-processing equipment handling the print job;

detecting horizontal locations of the control marks along the width of the print job; and responsive to detecting the locations of the control marks, generating flush lines for the print job that have altered optical densities at the horizontal locations, thereby preventing visual conflicts between the flush lines and the control marks that would cause the flush lines to be interpreted as control marks.

14. The medium of claim 13, wherein the method further comprises:

generating a flush line having a default optical density;

identifying an optical density of a control mark at a horizontal location along the width of the print job; and modifying the flush line to reduce the optical density of the flush line at the horizontal location below the optical density of the control mark.

15. The medium of claim 13, wherein the method further comprises:

generating a flush line having a default optical density;

identifying a control mark at a horizontal location along the width of the print job; and modifying the flush line to remove the flush line from the horizontal location.

16. The medium of claim 13, wherein the method further comprises:

generating a flush line having a default optical density;

identifying a control mark at a horizontal location along the width of the print job;

determining a triggering threshold of a down-stream sensor for the control mark; and modifying the flush line to reduce the optical density of the flush line at the location below the triggering threshold.

17. The medium of claim 13, wherein the method further comprises:

generating the control marks at pre-defined horizontal locations along the width of the print job based upon expected horizontal locations of sensors for the post-printing equipment.

18. The medium of claim 13, wherein the method further comprises:

for each page:

identifying control marks within the page; and generating a flush line for the page that has varying optical density along the width of the page based on the detected control marks for the page.

19. The medium of claim 13, wherein the method further comprises:

reducing the optical density of a flush line at the horizontal location of a detected control mark; and increasing the amount of ink applied to the detected control mark to compensate for the reduced optical density of the flush line.

20. The medium of claim 13, wherein the method further comprises:

determining a frequency at which a control mark at a horizontal location along the width of the print job repeats across multiple pages; and reducing the optical density of a flush line at the horizontal location based on the frequency.

* * * * *